United States Patent [19]

Turner

[11] Patent Number: 4,580,480

[45] Date of Patent: Apr. 8, 1986

[54] ACOUSTIC GUITAR

[76] Inventor: William H. Turner, 12 S. Monitor Pl., Tucson, Ariz. 85710

[21] Appl. No.: 523,426

[22] Filed: Aug. 16, 1983

[51] Int. Cl.[4] ..... G10H 3/00

[52] U.S. Cl. ..... 84/1.14; 84/DIG. 24; 84/1.16

[58] Field of Search ..... 84/DIG. 24, 1.14, 1.15, 84/1.16

[56] References Cited

U.S. PATENT DOCUMENTS 3,530,228 9/1970 Scherer ..... 84/1.16

4,290,331 9/1981 Izdebski ..... 84/1.14

*Primary Examiner*—Forester W. Isen

*Attorney, Agent, or Firm*—Drummond & Nissle

[57] ABSTRACT

Apparatus for controlling signals produced by a transducer carried by an acoustic guitar. The control apparatus is mounted on the guitar and does not affect the structure or tonal qualities of the hollow tone-producing body of the guitar.

8 Claims, 5 Drawing Figures

ACOUSTIC GUITAR

This invention relates to acoustic guitars.

More particularly, the invention relates to methods and apparatus for receiving and transmitting vibrational energy produced in the body of the guitar during use of the guitar.

In a further respect, the invention relates to tone and volume control apparatus for an acoustic guitar which permits a guitarist to readily and quickly adjust the tone and volume of an electronic signal produced by a transducer carrier by the guitar.

An acoustic guitar, as does a violin, includes a hollow tone-producing body, a bridge and a neck all comprised principally of wood. The quality of wood, orientation of the grain of the wood and craftsmanship of the luthier are all important factors in determining the tonal qualities of an acoustic guitar. In particular, the care taken in producing the hollow tone-producing body of a guitar will be crucial in determining tonal qualities such as richness, sweetness, balance, fullness, sonority, projection and bombastic quality.

The bridge is a vital link in the transmission of string vibrations and must be carefully attached to the body of the guitar. The entire generally planar continuous bottom surface of the bridge is glued to the upper plate of an acoustic guitar. Deviations in the thickness or mass of wood in portions of the bridge can deleteriously alter the overall tone of the guitar. As a result, during the many years that guitars have been constructed, the primary function of guitar bridges has been to carry the pins which receive and secure one end of each guitar string.

In order to maintain the tonal qualities inherent in the body of a well constructed guitar, it is important that apertures not be formed in the upper and lower plates or through the sides of the guitar other than at points at which apertures are normally located. The formation of additional apertures or the insertion of foreign objects such as screws in the plates of a guitar interferes with the travel of vibrations through the wood and alters the original tone imbued in the guitar by its maker.

Modern acoustic guitars often are each equipped with at least one transducer positioned on the guitar to absorb vibrations traveling through the upper plate and bridge of the guitar when the strings of the guitar are vibrating. Electrical signals produced by the transducer are transmitted through a wire to auxiliary processing equipment. Controls for altering the volume and tone of electrical signals produced by the transducer are positioned in the upper plate of the body beneath the strings or in the side wall of the guitar. Positioning transducer controls in the upper plate beneath the strings or in the side wall of the guitar makes utilization of the controls awkward for a guitarist while he is playing because he must move one of his hands away either from the neck or from the center of the body of the guitar to reach the controls. Positioning of the controls in the body of the guitar also affects the tonal qualities of the guitar.

Accordingly, it would be highly desirable to provide improved apparatus for an acoustic guitar which would permit a guitarist to rapidly adjust the tone and volume of vibrational signals being received and electrically transmitted by a transducer carried on the guitar and which would not, when installed on the guitar, alter the tonal qualities of the hollow tone-producing body of the guitar.

Therefore, it is the principal object of the invention to provide improved apparatus for controlling and adjusting the vibrational signals being received and electrically transmitted by a transducer carried by an acoustic guitar.

A further object of the instant invention is to provide improved apparatus for controlling signals produced and transmitted by a transducer means carried by a guitar, the control apparatus being mounted on the guitar without affecting the acoustical properties of the body of the guitar and being installed on the guitar without requiring alteration of the structure of the tone-producing body of the guitar.

Still another object of the invention is to provide improved apparatus for controlling signals produced by a transducer carried in the body of a guitar, the apparatus permitting a guitarist to quickly adjust transducer signals with the hand normally positioned over the strings in the center of the body of the guitar.

Yet a further object of the invention is to provide improved apparatus for controlling the signals produced by a transducer carried in a guitar, the apparatus being readily installed on and removed from the guitar without affecting the acoustical properties of the hollow tone-producing body of the guitar.

These and other, further and more specific objects and advantages of the invention will be apparent to those skilled in the art from the following detailed description thereof, taken in conjunction with the drawings, in which.

Briefly, in accordance with my invention, I provide an improved acoustic guitar. The guitar includes a hollow tone-producing structure having an upper table surface formed of wood, the table surface including internal tone-affecting components attached thereto; a wooden bridge having a generally planar bottom surface fixedly attached to the upper table surface of the hollow tone-producing structure; an elongate neck extending forwardly of the tone-producing structure and including a finger-board portion; a plurality of transversely spaced tunable strings under tension and attached at their forward ends to the outer end of the neck and at their other ends to the wooden bridge; transducer means carried on the guitar for receiving vibrational energy transmitted through the hollow tone-producing structure during use of the guitar and converting the vibrational energy to signals transmitted from the transducer means to auxiliary equipment for processing the signals; and, control means operatively associated with the transducer means for adjusting the signal transmitted from the transducer. The control means is mounted on the bridge such that the control means is generally carried on the bridge without contacting the hollow tone-producing structure and without altering the bombastic quality, sonority, projection and other tonal qualities of the tone-producing structure.

Figure 1:
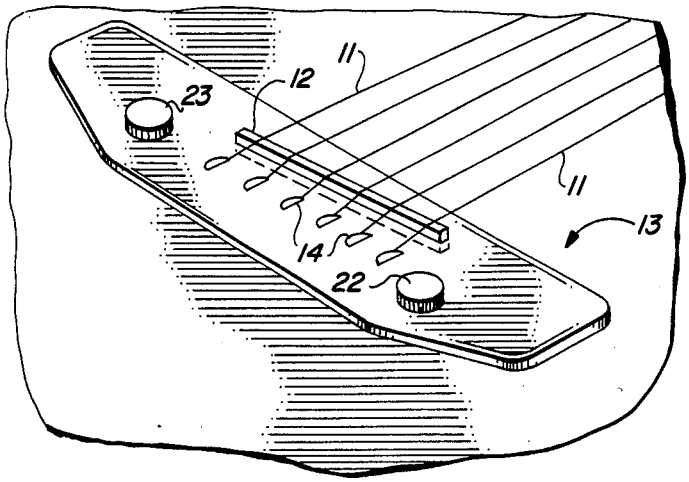
FIG. 1 is a perspective view illustrating a portion of an acoustic guitar constructed in accordance with the principles of the invention and having apparatus for controlling the volume and tone of a transducer carried by the guitar.
Figure 5:
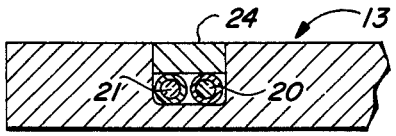
Figure 2:
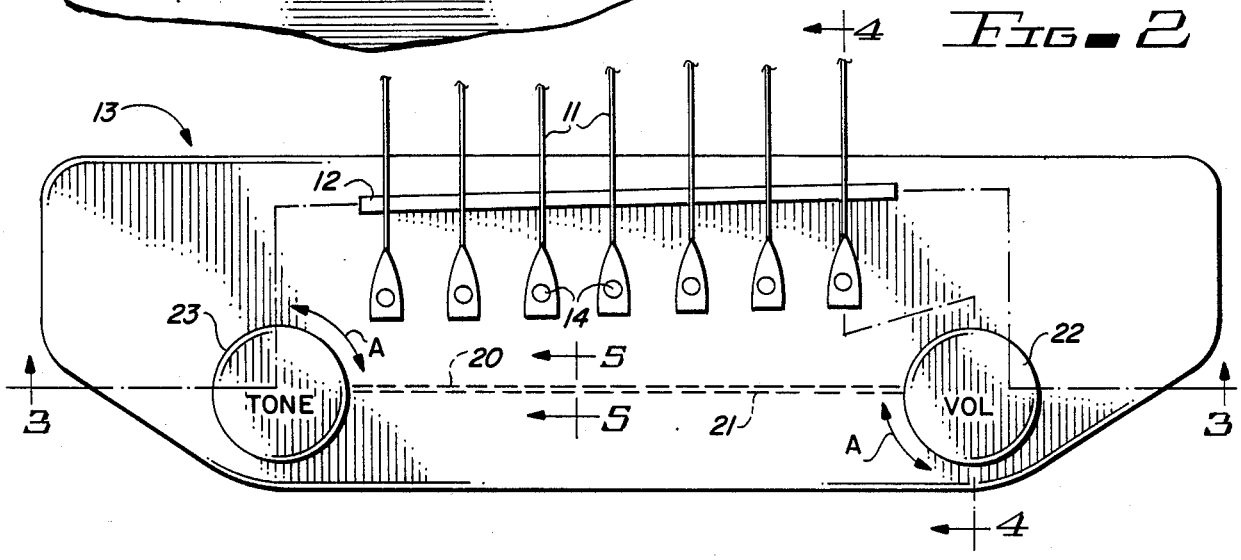
FIG. 2 is a top view of the bridge of the acoustic guitar of FIG. 1 further illustrating construction details thereof.

Turning now to the drawings, in which the presently preferred embodiments and best mode of the invention are shown for the purpose of illustrating the practice thereof and not by way of limitation of the scope of the invention and in which like reference characters identify corresponding elements throughout the several views, FIGS. 1–5 illustrate an acoustic guitar constructed in accordance with the principles of the invention. The well known wooden hollow tone-producing acoustic guitar body and the neck extending forwardly therefrom are, for the sake of clarity, generally omitted from the drawings. The body and other parts of the guitar can, in addition to being constructed with wood, also be fabricated from composite materials including graphite, wood fibers, and other substances. In FIG. 1, one end of each of tensioned strings 11 crosses upstanding saddle 12 and is connected to a pin 14 of bridge 13. Although not visible in the drawings, the other end of each of strings 11 is attached to the outer end of the neck of the guitar. Pins 14 are anchored in wooden bridge 13. Although pins 14 may extend downwardly through bridge 13 into upper wooden plate 15 of the body of the guitar, the bottom surface of bridge 13 adjacent upper plate 15 is generally planar and is glued to the upper planar surface of plate 15. The lower portion of saddle 12 is slipped into elongate groove 16 formed in plate 15. Before the lower portion of saddle 12 is slip-fit in groove 16, thin elongate transducer wafer 17 is inserted in the bottom of groove 16. Electric wire 19 leads from transducer volume control unit 22 downwardly through a first aperture formed in upper tone-producing plate 15 to auxiliary equipment (not shown) which processes the electrical signals from transducer 17 and unit 22 and, in most cases, feeds the signals to a speaker. A wire, indicated by line 18 in FIG. 3, leads downwardly from transducer wafer 17 through a second aperture formed in plate 15 and back up through said first aperture in plate 15 to volume control unit 22. Wires indicated by dashed lines 20, 21 interconnect transducer volume control unit 22 and transducer tone control unit 23. Unit 22 presently includes a miniature potentiometer. Unit 23 includes a miniature potentiometer, a capacitor and a resistor. Wires 20, 21 are positioned in grooves formed along the upper surface of bridge 13 and are then covered with material 24 (FIG. 5) which blends in with the color and texture of the wood of bridge 13.

Figure 3:
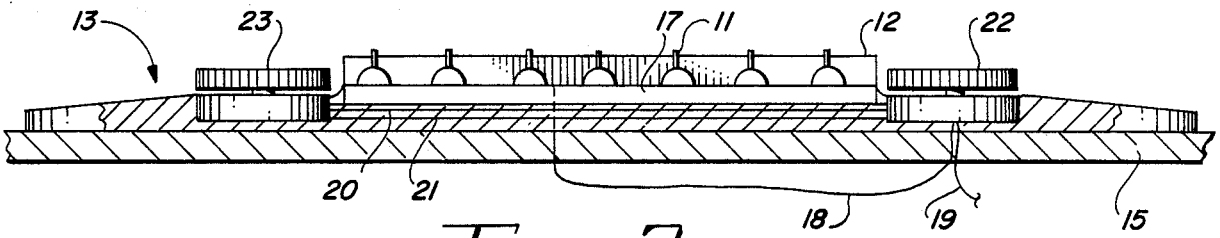
FIG. 3 is a sectional view of the bridge of FIG. 2 taken along section line 3—3 thereof and illustrating the emplacement of a transducer and transducer control apparatus therein.
Figure 4:
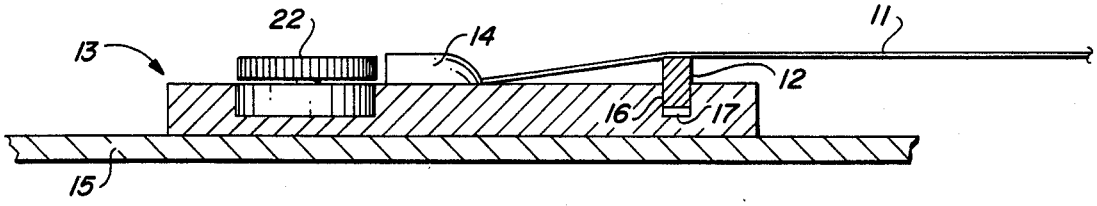
FIG. 4 is a side sectional view of the bridge of FIG. 2 taken along section line 4—4 thereof; and, FIG. 5 is a sectional view of a portion of the acoustic guitar bridge of FIG. 2 taken along section line 5—5 thereof and illustrating the emplacement of electrical wires therein.

As illustrated in FIG. 3, neither wires 20, 21 nor control units 22, 23 extend completely through bridge 13 and against the upper surface of plate 15. To maintain the tonal integrity of plate 15 and the hollow tone-producing body of the guitar, it is important that control units 22, 23 and wires 20, 21 be carried in bridge 13 spaced away from contact with plate 15.

Conventional acoustic guitar transducer control manes are mounted either in the side walls or upper plate 15 of the hollow tone-producing body of the guitar, and interfere with and alter the natural tonal-qualities of the body of the guitar. In addition, attempting to adjust the controls positioned in upper plate 15 or at the sides of the guitar is awkward for a guitarist and markedly interrupts the music being performed by the guitarist. In contrast, in the embodiment of the invention pictured in the drawings, transducer controls 22, 23 are not mounted in upper plate 15 or the sides of the guitar, but are instead adapted to be carried by the bridge of a guitar without contacting the hollow sound-producing body of the guitar. A guitarist can use the hand positioned over the body of the guitar to readily grasp and turn volume and tone control knobs 22, 23 in the directions indicated by arrows A in FIG. 2. The positioning of control knobs 22, 23 immediately adjacent saddle 12 greatly facilitates use of the control knobs by a guitarist.

A wide variety of control knobs, buttons, etc. can be mounted on bridge 13 for use in controlling vibrational signals received and transmitted by transducer means 17. Although in the embodiment of the invention shown in the drawings, the signals produced by transducer 17 are piezoelectrical, light optic, electromagnetic, or other forms of electronic signals could be produced and transmitted by appropriate means from transducer 17 to signal processing equipment. Units 22, 23 may be adapted to control the amplitude, wave form, frequency, or other desired characteristics of the piezoelectric or other signals produced by transducer 17 and transmitted through wire 18 or other means to auxiliary processing equipment. It is preferred that transducer 17 not be positioned intermediate bridge 13 and plate 15 but instead be carried in bridge 13 separated from and not contacting plate 15 so as not to interfere with the substantially continuous planar contact area between the bottom surface of bridge 13 and upper plate 15.

Although transducer controls similar to units 22, 23 have in the past consistently been mounted on plate 15 or in the side wall of the body of a guitar such controls may, in accordance with the invention, be positioned on the bridge 13 of a guitar provided the controls do not contact or pass through upper plate 15 of the body of the guitar. Such positioning of the controls on bridge 13 does not noticeably, if at all, affect the original tonal-qualities of the hollow body of the guitar.

An acoustic guitar can be readily modified with the transducer and/or transducer control system shown in FIGS. 1–5 by forming apertures in the upper portion of the guitar bridge to receive control units 22, 23 and by forming grooves in the upper surface of the bridge to receive wires 19–21 interconnecting control units 22, 23 and transducer 17. If necessary, a transducer wafer 17 may be positioned beneath saddle 12 of the bridge or elsewhere on the guitar.

As would be appreciated by those of skill in the art, in FIGS. 1–5, control units 22, 23, transducer wires 19–21 and transducer 17 can be removed from bridge 13 and the bridge repaired or a new bridge can be installed on plate 15 of the guitar.

Having described my invention in such terms as to enable those skilled in the art to understand and practice it, and having identified the presently preferred embodiments and best mode thereof, I claim:

1. An acoustic guitar comprising (a) a hollow tone-producing body structure having a planar upper table surface;

(b) a panel-shaped bridge having a generally continuous planar bottom surface fixedly attached to said upper table surface of said hollow tone-producing body structure and having an upper surface;

(c) an elongate neck attached to and extending forwardly of said hollow tone-producing body structure and including a finger-board portion and an outer end;

(d) an upstanding saddle mounted on said bridge;

(e) a plurality of transversely spaced tunable strings under tension and normally attached at their forwared ends to the outer end of said neck and at their other ends to said bridge, said other ends of said strings extending across a first portion of said upper surface of said bridge and across said saddle;

(f) transducer means mounted on said bridge for receiving vibrational energy transmitted to said bridge from said hollow tone-producing body structure during use of said guitar, a solid portion of said bridge being intermediate said transducer means to prevent said transducer means from extending through said continuous planar bottom surface of said bridge to contact said upper table of said hollow tone producing body structure;

(g) first manually adjusted control means operatively associated with said transducer means and mounted on a second portion of the upper surface of said bridge, said second portion of said bridge being spaced laterally away from said strings extending over said first portion of said bridge such that a guitar player can readily grasp and adjust said control means without being obstructed by said strings, a solid portion of said bridge being intermediate said control means and said upper table surface to prevent said control means from extending through said continuous planar bottom surface of said bridge to contact said upper table surface of said hollow tone producing body structure, said control means receiving electrical signals produced by said transducer means and controlling and transmitting said signals to auxiliary signal processing equipment; and, (h) first electrically conductive means interconnecting said transducer means and control means for transmitting electrical signals from said transducer means to said control means; the positioning of said transducer means and control means on said bridge such that the integrity of said continuous planar bottom surface of said bridge is maintained permitting said transducer means and said control means to be carried by said bridge without altering the bombastic qualities, sonority, projection and other tonal qualities of said hollow tone-producing body structure.

2. The acoustic guitar of claim 1 wherein said control means includes (a) a first manually adjusted element; and (b) a first potentiometer operatively associated with and controlled by said first element.

3. The acoustic guitar of claim 2 including (a) second manually adjusted control means operatively associated with said first control means and mounted on a third portion of said upper surface of said bridge, said third portion of said bridge being spaced laterally away from said strings extending over said first portion of said bridge such that a guitar player can readily grasp and adjust said second control means without being obstructed by said strings, a solid portion of said bridge being intermediate said second control means and said upper table surface to prevent said control means from extending through said continuous planar bottom surface of said bridge to contact said upper table surface of said hollow body structure, said second control means receiving electrical signals from said first control means; and, (b) second electrically conductive means interconnecting said first and second control means to carry electrical signals from said first control means to said second control means.

4. The acoustic guitar of claim 3 wherein (a) said second control means includes (i) a second manually adjusted element; and, (ii) a potentiometer operatively associated with and controlled by said second element; and, (b) said second electrically conductive means comprises a pair of wires extending through said bridge between said first and second control means, a solid portion of said bridge being intermediate said wires and said upper table surface to prevent said wires from extending through said continuous planar bottom surface of said bridge to contact said upper table surface of said hollow body structure.

5. The acoustic guitar of claim 4 wherein (a) said first control means adjusts the volume of electrical signals received from said transducer means, and (b) said second control means adjusts the tone of signals produced by said transducer means.

6. The acoustic guitar of claim 5 wherein said first and second manually adjusted elements are rotatably mounted on said bridge.

7. The acoustic guitar of claim 6 wherein said transducer is mounted in said bridge beneath and in contact with said saddle.

8. The acoustic guitar of claim 7 wherein said bridge is unitary.

* * * * *